US005330390A

United States Patent [19]

Liebert et al.

[11] Patent Number: 5,330,390

[45] Date of Patent: Jul. 19, 1994

[54] RIDER PROPELLED ROUNDABOUT

[76] Inventors: Tim C. Liebert, 5815 W. 88th St., Overland Park, Kans. 66207; Frederick Houghland, 401 Michele, Coffeyville, Kans. 67337

[21] Appl. No.: 940,637

[22] Filed: Sep. 4, 1992

[51] Int. Cl.[5] ..... A63G 1/16

[52] U.S. Cl. ..... 472/23; 472/19; 472/24

[58] Field of Search ..... 472/19, 23, 24, 22, 472/14, 21

[56] References Cited

U.S. PATENT DOCUMENTS

| | | | |
|---|---|---|---|
| 1,068,472 | 7/1913 | Whitman et al. | 472/23 |
| 2,560,703 | 7/1951 | Sebel . | |
| 2,560,704 | 7/1951 | Sebel . | |
| 2,686,674 | 8/1954 | Behrens | 472/19 |
| 2,693,958 | 11/1954 | Ellenberger . | |
| 2,699,335 | 1/1955 | Krueger, Jr. . | |
| 2,739,811 | 3/1956 | Persons . | |
| 2,943,854 | 7/1960 | Levinson . | |
| 3,612,518 | 10/1971 | Bennett | 472/23 |
| 4,119,310 | 10/1978 | Trubody . | |
| 4,245,837 | 1/1981 | Menschel . | |

FOREIGN PATENT DOCUMENTS

| | | | |
|---|---|---|---|
| 486495 | 9/1952 | Canada | 472/24 |

*Primary Examiner*—Carl D. Friedman
*Assistant Examiner*—Kien Nguyen
*Attorney, Agent, or Firm*—Hovey, Williams, Timmons & Collins

[57] ABSTRACT

A rider propelled roundabout apparatus includes a stand and a roundabout assembly supported on the stand for rotation about a substantially vertical axis. The assembly is provided with at least one seat for supporting a rider, and a drive bar is supported on the stand for rotation relative to the stand. A roller clutch situated between the stand and the drive bar prevents rotation of the drive bar in a first rotary direction while permitting rotation of the drive bar in a second rotary direction. The rider propels the assembly in the second rotary direction by exerting a force on the drive bar in the first rotary direction. The drive bar is free to rotate with the rider in the second rotary direction so that the rider may continuously hold onto the drive bar and exert additional force on the drive bar in the first rotary direction at any time to further propel the assembly.

7 Claims, 1 Drawing Sheet

RIDER PROPELLED ROUNDABOUT

BACKGROUND OF THE INVENTION

1. Field of the Invention

The present invention relates generally to toys and, more particularly, to a roundabout apparatus which permits a rider to propel himself along a circular path around a stationary stand.

2. Discussion of the Prior Art

It has long been known to provide a merry-go-round or roundabout which permits a number of riders supported on the device to propel themselves around the central upstanding post of a stationary stand. Numerous drive mechanisms have been conceived in an attempt to increase the level of amusement derived from operation of the device. However, conventional constructions are complex, requiring a large number of specially constructed parts which result in a device that is expensive to produce and difficult to assemble.

Examples of known merry-go-rounds include U.S. Pat. Nos. 2,560,703, 2,693,958, 2,699,335, 2,739,811, 2,943,854 and 4,119,310.

OBJECTS AND SUMMARY OF THE INVENTION

It is an object of the present invention to provide a roundabout apparatus provided with a simple construction which permits the use of readily available parts in order to reduce the cost of the apparatus and simplify assembly.

It is another object of the invention to provide a roundabout apparatus that is easy to assemble and disassemble so that it may be easily packaged and/or stored when not in use.

In accordance with these and other objects evident from the following description of a preferred embodiment of the invention, a rider propel led roundabout apparatus includes a stand for supporting the apparatus upon the ground, and a roundabout assembly supported on the stand for rotation relative to the stand about a substantially vertical axis. The assembly includes at least one seat for supporting a rider.

A drive bar is supported on the stand for rotation relative to the stand about an axis collinear with the axis of rotation of the assembly. A roller clutch is situated between the stand and the bar for preventing rotation of the bar in a first rotary direction relative to the stand while permitting rotation of the bar in a second rotary direction relative to the stand.

The rider propels the assembly in the second rotary direction by exerting a force on the bar in the first rotary direction, the bar being free to rotate with the rider in the second rotary direction so that the rider may continuously hold onto the bar and exert additional force on the bar in the first rotary direction at any time to further propel the assembly.

By providing this construction, numerous advantages are realized. For example, by providing a roller clutch between the stand and the drive bar, any force exerted on the bar in a first rotary direction is conveyed directly to the stand allowing the rider to push off from the bar in order to travel along the circular path around the stand. However, as the rider travels along the circular path, the bar is free to rotate in the second rotary direction along with the rider so that the rider may constantly maintain a grip on the bar. Thus, the rider is free, at any time, to exert additional force on the bar in the first rotary direction to further propel himself around the stand.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
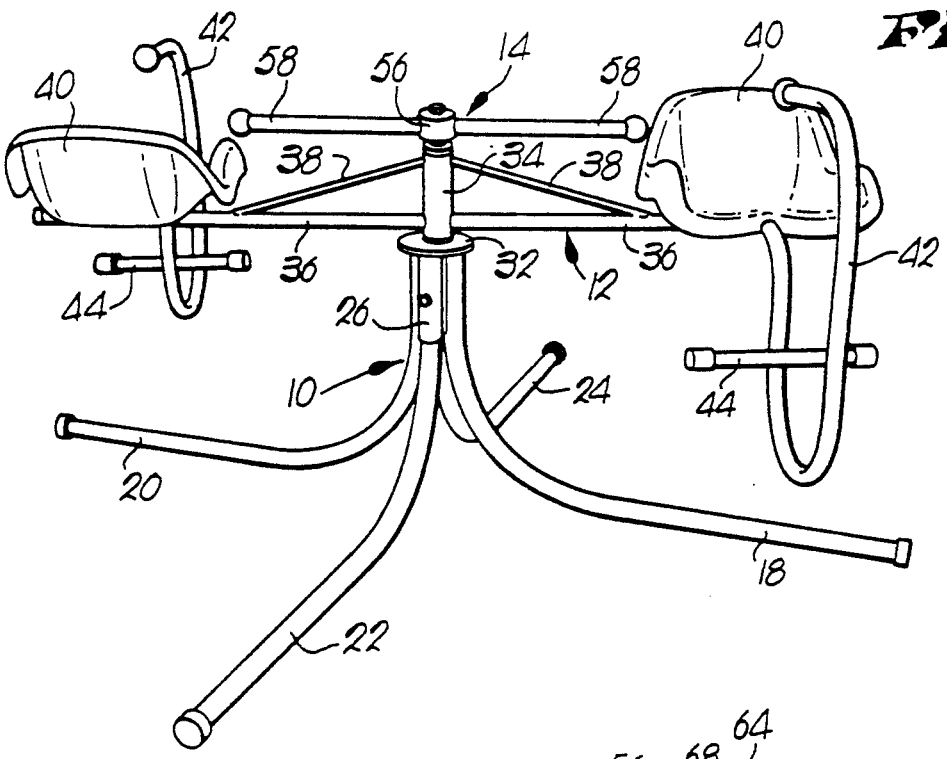
FIG. 1 is a perspective view of a roundabout apparatus constructed in accordance with the preferred embodiment.

As shown in FIG. 1, a roundabout apparatus constructed in accordance with a preferred embodiment of the present invention includes a stand 10, a rotatable roundabout assembly 12, and a rotatable drive bar 14.

The stand 10 includes a center post 16 formed of a cylindrical tube, and a plurality of legs 18, 20, 22, 24 attached to the center post and extending downward and radially outward from the post in various radial directions in order to provide support for riders playing on the apparatus. Preferably, four legs are provided, each extending radially from the center post in a direction displaced 90° from the adjacent legs.

Figure 2:
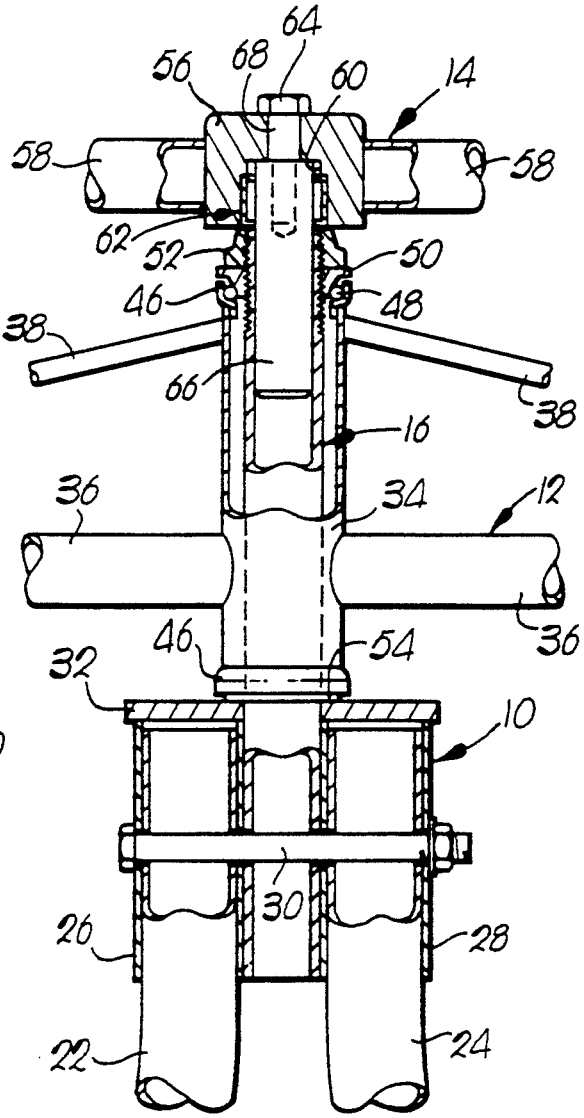
FIG. 2 is a side elevational view, of a central region of the apparatus, partially in section, illustrating details of the construction of the apparatus.

Two of the legs 22, 24 which oppose one another are made removable by providing a pair of sleeves 26, 28 which are secured to the center post and which receive the legs 22, 24 in order to support the legs on the apparatus. As shown in FIG. 2, the sleeves 26, 28 and the two removable legs 22, 24 are provided with transverse holes which permit the passage of a bolt 30 for securing the legs within the sleeves and holding the legs in a supportive position such that the legs extend radially outward in a desired relationship relative to the remaining legs.

Although the legs in the preferred embodiment are formed of tubular steel which is bent to provide the desired shape, it is noted that other materials could be used, and that the base could be formed of a single, large plate-shaped base member that is attached to the center post. However, an advantage is obtained by using the construction illustrated since tubular steel is inexpensive, easy to work with, and permits ready assembly and disassembly of the stand.

An annular steel plate 32 is provided on the center post 16 and covers the top ends of the legs 18, 20, 22, 24. This plate 32 may be welded to the legs and to the center post in order to increase the strength of the apparatus and to cover the upper ends of the legs. The annular plate 32 also provides a surface on which the roundabout assembly 12 is supported.

Returning to FIG. 1, the roundabout assembly 12 includes a hollow, cylindrical collar 34, preferably formed of steel and having upper and lower ends. The assembly also includes a pair of radially extending arms 36, preferably formed of hollow steel tubes and having first ends affixed to the collar and second, free ends radially spaced from the collar. An angled steel brace 38 is connected between each radial arm 36 and the upper end of the collar 34 in order to provide additional support to the radial arms relative to the collar. The braces 38 are attached by welding or other suitable means.

A seat 40 formed of plastic or any other suitable material is secured to the free end of each radial arm 36 and is turned relative to the central longitudinal axis of the arm by approximately 90° so that a rider positioned in the seat faces the direction in which the seat travels during rotation of the roundabout assembly on the stand.

A shaped, curved handle bar 42 formed of hollow steel tubing or the like is also secured to the free end of each radial arm 36 and is generally disposed in a plane that is perpendicular to the longitudinal axis of the arms 36. The handle bar 42 includes an upper end disposed in front of the seat so that a rider may grip the handle bar and support himself while playing on the apparatus. Although not illustrated in the drawing figures, a seat belt may also be provided for holding the rider in the seat. A foot rest 44 may be secured to the handle bar for allowing the rider to further support himself in the seat while playing. Preferably, each handle bar is bolted to the associated radial arm to permit the handle bars to be removed from the apparatus for storage or packaging.

As shown in FIG. 2, the collar 34 is provided with upper and lower outer bearing races 46 which are secured to the collar and within which ball bearings 48 are received. The upper end of the center post includes an outer threaded surface on which an inner race 50 is received. The inner race 50, together with the upper outer race 46 of the collar, retains the ball bearings in position between the center post and the collar. A lock nut 52 is threaded onto the center post and engages the upper inner race to secure the upper inner race in position and to retain the collar between the annular plate 32 and the upper inner race 50 supported on the center post. A lower inner race 54 is provided on the annular plate and, together with the lower outer race 46 retains ball bearings in position between the lower end of the center post and the collar. In this manner, the collar 34 is supported at the upper and lower ends relative to the center post 16 to permit smooth, controlled rotation of the collar on the center post.

Returning again to FIG. 1, the drive bar 14 is shown to include a central steel hub 56 and a pair of tubular steel arm portions 58 attached to the hub and extending radially in opposite directions. As illustrated in FIG. 2, the hub 56 is provided with a cup-shaped receptacle 60 having a central axis extending in a direction transverse to the longitudinal axis of the drive bar. A roller clutch 62 is disposed within the receptacle 60. A hole extends through the hub along the central axis of the receptacle and receives a threaded member 64.

One example of a roller clutch which may be used with the preferred embodiment is marketed by Torrington.

The center post 16 includes a solid steel, cylindrical end piece 66 that is preferably press fit into the upper end of the center post and which is tapped to receive the threaded member 64 after the drive bar 14 is received on the end piece with the end piece inserted in the receptacle 60. A spacer 68 may be provided through which the threaded member passes when the drive bar is connected to the center post. The spacer 68 permits the threaded member 64 to retain the drive bar on the center post while permitting rotation of the drive bar.

Figure 3:
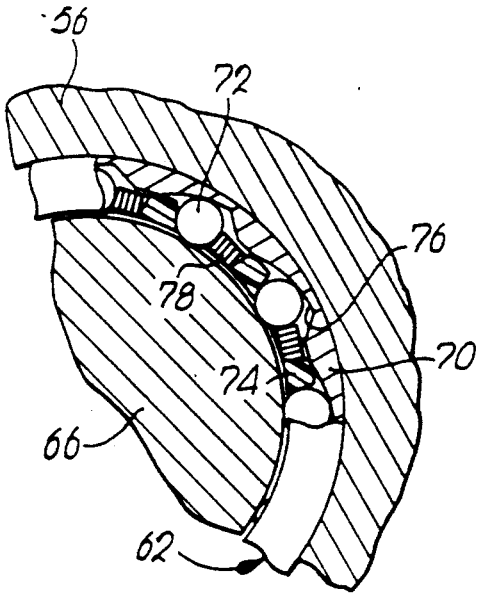
FIG. 3 is a bottom sectional view of an upper end of the center post, illustrating a roller clutch positioned between a center post and a drive bar of the apparatus.

The construction of the roller clutch 62 is shown in FIG. 3, and includes an outer sleeve 70 secured to the hub 56 of the drive bar 14 and a plurality of rollers 72 retained between the outer sleeve and the end piece 66 of the center post 16. Preferably, a means is provided for retaining the rollers between the end piece 66 and the outer sleeve 70. Preferably, this means includes an inner sleeve 74 which, together with the outer sleeve, defines a plurality of cavities within which the rollers 72 are retained. Each of these cavities includes a radially outer surface 76 that angles inward in one circumferential direction toward the central longitudinal axis of the receptacle in order to define a first circumferential region of the cavity having a radially extending depth that is less than the diameter of the rollers 72, and a second circumferential region having a radially extending depth that is greater than the diameter of the rollers. A spring 78 is provided in each cavity for biasing the roller associated therewith toward the first circumferential region.

During rotation of the hub 56 in the clockwise direction, as shown in FIG. 3, the springs 78 bias the rollers 72 toward the first circumferential regions and the rollers engage the end piece 66 of the center post 16 and the outer sleeve 70 of the roller clutch to prevent relative rotation between the hub and center post. When the hub is rotated in the opposite direction, the rollers 72 move against the bias of the springs to the second circumferential regions of the cavities, allowing the hub to rotate on the center post.

In order for riders playing on the apparatus to propel themselves relative to the stand 10, they simply reach forward from their seats and pull on the drive bar 14. This pulling force is transmitted directly to the center post 16 by the rollers of the roller clutch which are biased toward the first circumferential regions of the clutch. As a result of the riders pulling on the drive bar, the roundabout assembly spins on the center post sending the riders around the center post along a circular path.

Once the riders have pulled themselves even with the drive bar in the circumferential direction of the apparatus, they can maintain their grip on the drive bar 14 and the bar rotates with them since this rotary movement moves the rollers 72 of the roller clutch 62 against the bias of the springs 78 into the second circumferential regions of the cavities defined in the roller clutch. Thus, repetitive pulling on the drive bar may be carried out by the riders in a manner simulating a rowing action.

Although the invention has been described with reference to the preferred embodiment illustrated in the drawing figures, it is noted that substitutions may be made and equivalents employed herein without departing from the scope of the invention as recited in the claims.

What is claimed is:

1. A rider propelled roundabout apparatus comprising:

a stand for supporting the apparatus upon the ground, the stand including a vertical center post and a plurality of depending legs;

a roundabout assembly supported on the stand for rotation relative to the stand about a substantially vertical axis, the assembly including at least one seat for supporting a rider;

a drive bar supported on the stand for rotation relative to the stand about an axis collinear with the axis of rotation of the assembly; and a roller clutch situated between the stand and the drive bar for preventing rotation of the drive bar in a first rotary direction relative to the stand while permitting rotation of the drive bar in a second rotary direction relative to the stand, the rider propelling the assembly in the second rotary direction by exerting a force on the drive bar in the first rotary direction, the drive bar being free to rotate with the rider in the second rotary direction so that the rider may continuously hold onto the drive bar and exert additional force on the drive bar in the first rotary direction at any time to further propel the assembly;

the center post of the stand being formed of a hollow, cylindrical tube having upper and lower ends, the lower end being connected to the legs, and the upper end receiving a solid cylindrical end piece on which the drive bar is supported, the roller clutch being disposed between the end piece and the drive bar;

wherein the drive bar includes a centrally located hub formed with a cup-shaped receptacle within which the roller clutch is secured, the hub being further provided with a through hole passing through the receptacle for permitting the hub to be retained on the end piece.

2. A roundabout apparatus as recited in claim 1, wherein the roundabout assembly includes a collar and a radially extending arm on which the seat is secured, the collar being received on the center post for rotation relative to the stand.

3. A roundabout apparatus as recited in claim 2, further comprising at least one bearing assembly between the center post of the stand and the collar of the roundabout assembly for permitting rotation of the collar on the center post.

4. A roundabout apparatus as recited in claim 3, wherein two radially extending arms are provided, each of the arms extending in a direction opposite to the other arm and being provided with a seat for supporting a rider.

5. A roundabout apparatus as recited in claim 4, wherein the drive bar is centered on the axis to present two opposing, radially extending portions.

6. A roundabout apparatus as recited in claim 1, wherein the drive bar is rotatable relative to the roundabout assembly.

7. A roundabout apparatus as recited in claim 1, wherein the end piece is tapped, the apparatus further comprising a bolt passing through the through hole of the hub and being received in the end piece, the bolt retaining the hub on the end piece while allowing relative rotation of the hub.

* * * * *